United States Patent [19]

Ford et al.

[11] Patent Number: 4,494,607

[45] Date of Patent: Jan. 22, 1985

[54] METHOD OF CLEANING AND INHIBITING SUCKER ROD CORROSION

[76] Inventors: Michael B. Ford, General Delivery, Vernal, Utah 84078; Jim B. Griffin, 4518 Graves, Odessa, Tex. 79762

[21] Appl. No.: 493,029

[22] Filed: May 9, 1983

[51] Int. Cl.[3] ..... E21B 19/00

[52] U.S. Cl. ..... 166/311; 51/319; 166/244 C

[58] Field of Search ..... 166/311, 244 R, 244 C, 166/81; 175/84, 208; 51/5 R, 426, 410, 319; 15/256.5, 210 B

[56] References Cited

U.S. PATENT DOCUMENTS

| | | | |
|---|---|---|---|
| 1,725,593 | 8/1929 | Mobley | 15/210 B |
| 2,621,446 | 12/1952 | Russell | 51/14 |
| 3,475,781 | 11/1969 | Grant | 175/84 X |
| 4,279,300 | 7/1981 | Wirsch | 166/90 |

FOREIGN PATENT DOCUMENTS

| | | | |
|---|---|---|---|
| 18152 | 10/1980 | European Pat. Off. | 51/426 |
| 675171 | 7/1979 | U.S.S.R. | 175/84 |

*Primary Examiner*—Stephen J. Novosad

*Assistant Examiner*—Michael Starinsky

*Attorney, Agent, or Firm*—Marcus L. Bates

[57] ABSTRACT

Method of cleaning tubular goods, especially sucker rods, and inhibiting the sucker rods against corrosion as the rod string is being withdrawn from a borehole. The method is carried out by the provision of an enclosure which is attached to the upper end of a cased borehole. The upper end of the sucker rod string is extended axially through the enclosure as the rod string is withdrawn from the casing. A medial length of the rod string is engaged by a resilient packer device which wipes the rod clean of well fluids and loose debris. The rod string is next cleaned within a second chamber by impacting the outer surface thereof with an abrasive substance. The rod surface is again cleaned of any residual material. The rod is then moved through another chamber where corrosion inhibitor is applied to the external surface of the rod. As each treated joint of rod is withdrawn from the enclosure, the rod joints are sequentially unscrewed and suitably stacked, where the rods are protected from the elements, as well as being protected when the rods are subsequently made up into a rod string as the rod is replaced into a borehole.

11 Claims, 6 Drawing Figures

METHOD OF CLEANING AND INHIBITING SUCKER ROD CORROSION

BACKGROUND OF THE INVENTION

In the art of drilling and producing hydrocarbons from an oil well, many various tubular goods, such as drill pipe, production tubing, and sucker rod must be used downhole in the borehole. In producing the well, for example, it is customary to employ a pump-jack unit which reciprocates a string of sucker rod. The sucker rod extends downhole to a downhole pump so that the pump-jack unit reciprocates the rod string which in turn reciprocates the downhole pump and produces oil.

A string of sucker rod is made up of individual joints which are approximately 25 feet in length. The rod joints are connected together by a coupling member. The string of sucker rod may be more than a mile in length. The sucker rod is quite costly and it is advantageous to protect the rod against corrosion.

From time to time, it is necessary to pull the entire rod string out of the borehole so that various different repairs or changes can be made to the oil well. This necessitates unscrewing each joint as the string is lifted from the hole. The sucker rod joints are then stacked until the work on the well has been completed and then the rod joints are made back into a string by reversing the above procedure.

The sucker rods are sometimes coated with foreign matter, including corrosive well fluids, scale, paraffin, oxidation products, and other debris. When the rods are subsequently replaced into the borehole, they continue to deteriorate because the rod is located in the corrosive well fluids.

Corrosion attack on sucker rod steel accounts for about one-half of all sucker rod failures and contributes to many other stress and abrasion failures. The failure mechanism is called stress corrosion fatigue where a load is concentrated at a corrosion pit. Simply stated, corrosion on sucker rods is the reduction of a man-made material, steel, to its natural state or lower energy level. Elemental iron in steel combined with moisture or acid to forms other compounds, such as iron oxide, sulfide, carbonate, etc. Corrosion control is possible with an effective chemical inhibitor program. Chemical inhibition of sucker rods is accomplished by applying a film of inhibitor to the rod which acts as a barrier between the steel and its corrosive environment. Generally, well fluids will contain two or more corrodents that work together to cause attack on steel. Scales, such as iron oxide, calcium sulfate, iron sulfide, and iron carbonate, should be—but are often not—prevented from forming on sucker rods where they reduce the effectiveness of the chemical inhibitors.

When an adequate inhibitor film is not maintained on a sucker rod, the corrosion process accelerates, causing pitting of the rod. These pits represent weak points in the rod string because the cross-sectional area of the rod at the pit is reduced. Cyclic stresses, along with other induced stresses, cause the rod to commence cracking at these pits and eventually the rod will fail. Anytime a contaminated rod string is withdrawn from a well, wherein the rod surface does not have a visible coating of inhibitor, it would be desirable to clean the rod string down to bare metal and apply a film of inhibitor.

Accordingly, as rod is removed from the wellbore, it would be desirable to be able to present a clean inhibited rod at the wellhead which is much more satisfactorily handled by workmen as opposed to the contaminated rod. Moreover, it would be advantageous to clean and inhibit the rod as it is being withdrawn from the wellbore so that the threads thereof do not become contaminated with the foreign matter. Furthermore, it would be desirable for all sorts of various tubular goods, including the rod string, to be cleaned and inhibited so that while the tubular goods are stored, as well as when the string is replaced within the borehole, the life thereof is greatly extended.

Method and apparatus by which the above desirably features are attained is the subject of the present invention.

SUMMARY OF THE INVENTION

Method and apparatus by which tubular goods, such as drill string, production tubing, and sucker rods are cleaned and inhibited as the string is withdrawn from a borehole. The invention is carried out by attaching an enclosure to the upper end of a cased borehole. The tubular goods, such as a rod string, for example, extend axially through the enclosure so that a marginal length of the rod string can be treated by the apparatus housed within the enclosure prior to each rod joint being broken out of the string.

The enclosure includes a lowermost cleaning chamber having a resilient packer element associated therewith which engages and cleans well fluids and debris from the exterior surface of the rod string as the string passes through the chamber. A second chamber overlies the cleaning chamber and includes blast means which impacts abrasive material against the outer peripheral sidewall of the rod, thereby removing scale and rust therefrom.

Another cleaning chamber overlies the chamber containing the blast means, and includes a resilient packer device which engages and removes any foreign material that may remain on the rod after the blasting action has taken place.

The rod is next inhibited against corrosion by passing the rod through a treatment chamber where a coating of corrosion inhibitor material is applied to the outer surface of the rod.

The inhibited rod emerges from the enclosure, is unscrewed from the string, and stacked until it is needed again. The inhibited rod resists further degradation while stored in the open, and moreover, the inhibited rod will resist corrosion when it is replaced downhole in a borehole.

It is also advantageous to clean rod strings because excessive buildup of contaminants often become dislodged and fall to the bottom of the string, causing mechanism associated with the downhole pump to become plugged or stuck. It is more desirable to clean and inhibit a rod string at the wellsite rather than at another prepared site because of the time and expense involved in moving the rods.

Accordingly, a primary object of the present invention is the provision of method and apparatus for cleaning and inhibiting sucker rods as the rod string is being withdrawn from a borehole.

Another object of the invention is to provide a method by which sucker rods are cleaned and inhibited as the rod string is being withdrawn from the borehole by the provision of an enclosure divided into chambers, with the lowermost chamber cleaning well fluid and foreign matter from the rod surface, a second chamber which includes a blast means therein which blasts abrasive material onto and cleans the rod surface, a third chamber which cleans the abrasive residue from the rod surface, and an inhibiting chamber having means which applies a corrosion inhibiting agent to the rod surface.

A further object of this invention is to disclose and provide an enclosure for cleaning and inhibiting sucker rod, said enclosure having an axial passageway axially aligned with a wellbore and having axially spaced apart chambers formed therein, with the lowermost chamber thereof having means for wiping the exterior of the rod string to remove foreign matter therefrom, a second chamber for directing a blast of abrasive material onto the exterior of the rod string, a cleaning chamber which cleans residual blasting material from the rod surface, and a coating chamber wherein a corrosion inhibitor is applied to the exterior of the rod string.

A still further object of this invention is to provide method and apparatus by which a rod string is cleaned and inhibited as it is brought out of a wellbore, and thereafter the rod string is broken down into individual rod joints.

An additional object of the present invention is the provision of method and apparatus by which a string of sucker rod is cleaned and inhibited with an inhibiting agent as the rod string is removed from an oil well.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

Figure 1:
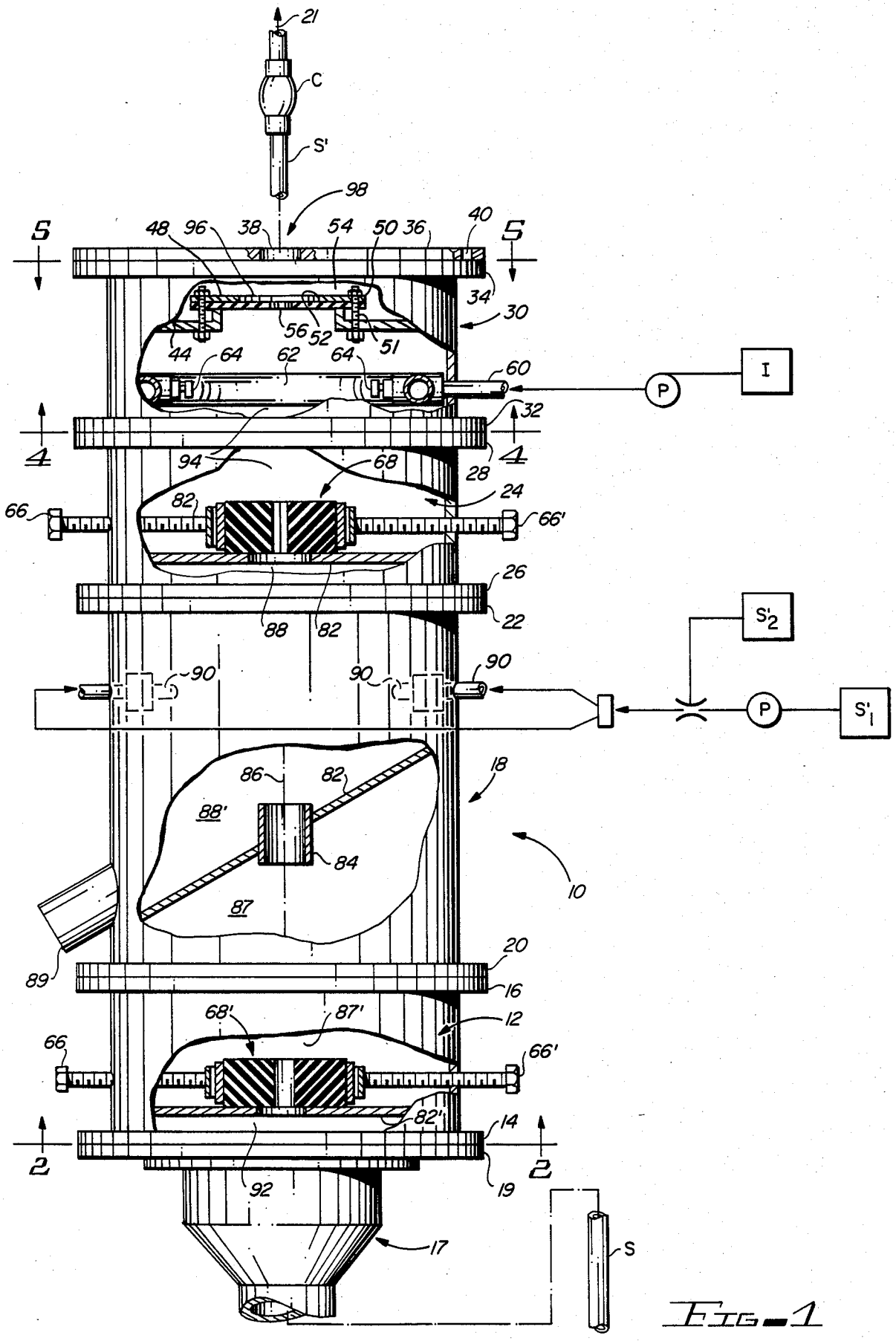
FIG. 1 is an elevational, schematical view of apparatus for carrying out the method of the present invention, with some parts thereof being removed therefrom, and some of the remaining parts being shown in cross-section.

In FIG. 1, there is schematically disclosed in a more or less diagrammatical manner a method and apparatus for cleaning and inhibiting sucker rods as a rod string is being withdrawn from a borehole. The apparatus 10 includes the illustrated enclosure which is separated into a primary stripping chamber 12 having a lower flange 14 removably attached to a wellhead adapter flange 19. A wellhead 17 can take on a number of different forms and is well known to those skilled in the art. The wellhead 17 forms the upper terminal end of a cased borehole, and is attached to the adapter flange 19.

An upper flange 16 is attached to a second or blasting chamber 18. The blasting chamber includes a lower flange 20 attached to the before mentioned flange 16. The blasting chamber includes an upper flange 22 for connection to the lower end of a third or stripping chamber 24. Flange 26 forms the lower end of the stripping chamber and is connected to the before mentioned flange 22. Upper flange 28 of the stripping chamber is attached to a fourth chamber 30 which is in the form of an inhibitor treatment chamber. The inhibitor chamber 30 includes a lower flange 32 which bolts to flange 28, and an upper flange 34 which bolts to a blind flange 36. The blind flange 36 includes a central aperture formed therethrough through which a string of sucker rods can extend.

The dot-dash line at 86 indicates the central axis of an axial passageway along which the string of sucker rods S′ can be longitudinally moved. The flange 36 includes a bolt circle 40 which coincides with bolt circles associated with flanges 14, 16, 20, 22, 26, 28, 32, and 34.

Figure 2:
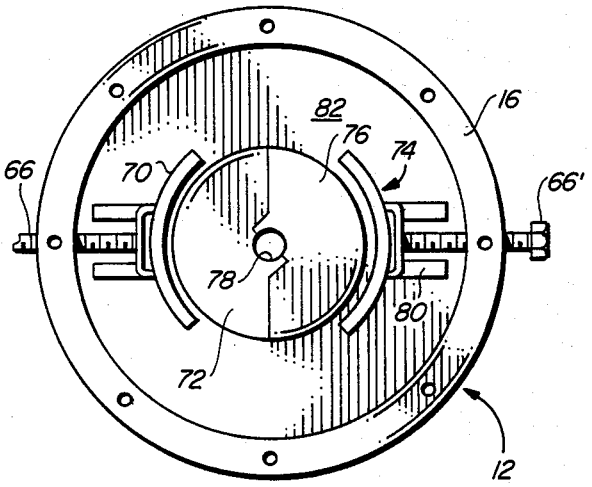
FIG. 2 is a cross-sectional view taken along line 2—2 of FIG. 1.
Figure 3:
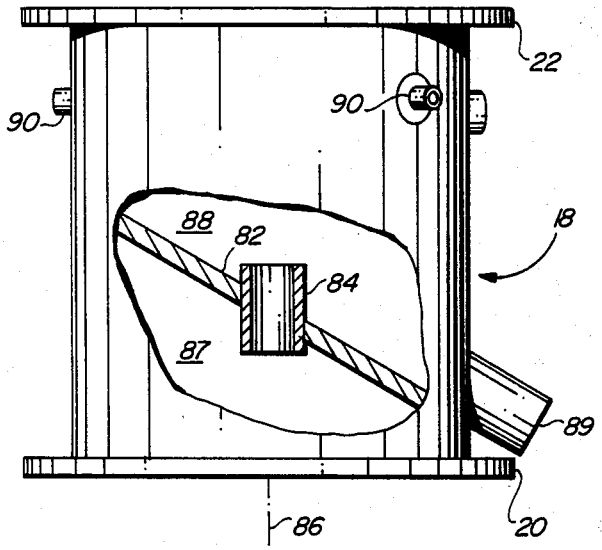
FIG. 3 is an enlarged, side view of part of the apparatus disclosed in FIG. 1, with some parts thereof being removed therefrom, and some other remaining parts being shown in cross-section.

The first or stripping chamber 12 and the third or stripping chamber 24 are identical to one another and further details thereof are illustrated in FIG. 2. The second or blasting chamber 18 is superimposed upon the first stripping chamber 12 and the details thereof are illustrated in FIG. 3. The fourth or inhibitor treatment chamber 30 is superimposed upon the stripping chamber 24. The details of the inhibitor treatment chamber 30 are illustrated in FIG. 4.

Figure 5:
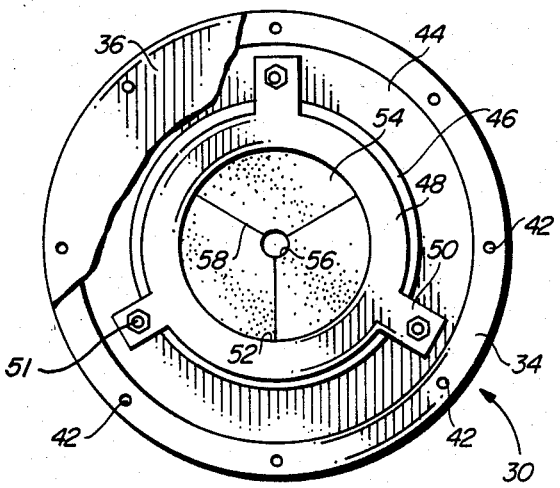
FIG. 5 is an enlarged, cross-sectional view taken along line 5—5 of FIG. 1; and, FIG. 6 is a schematical flow sheet which sets forth the method of the present invention.

Looking now to the details of FIG. 5, it will be noted that plate member 36 is bolted onto and forms the upper terminal end of the treatment chamber 30. Bolt circle 42 is formed through flange 34 and the plate 36. A large annular plate 44 is welded to the interior wall of chamber 30. A small inside diameter cylindrical skirt 46 has one terminal end thereof welded to annular plate 44 with the opposed end thereof freely extending from the annular plate 44. A small annular plate 48 is provided with outwardly directed ears 50 spaced 120° apart. The ears rest within the illustrated upwardly opening slots. The illustrated bolts are received through the ears with one end of the bolt being attached to the large annular plate 44 and the other end of the bolt securing the ears of small plate 48. Numeral 52 indicates the inside diameter of the small plate 48. The small annular plate 48 is seen to capture a resilient wiper member 54 between an adjacent apertured plate member 44′ illustrated in FIG. 4. Numeral 56 indicates a central aperture which is aligned with the axial passageway 86. The resilient member 54 is split radially outwardly from aperture 56, as indicated by the numeral 58, in FIG. 5.

Figure 4:
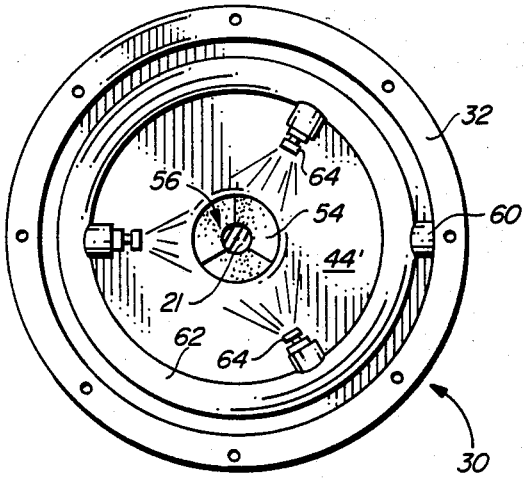
FIG. 4 is an enlarged, cross-sectional view taken along line 4—4 of FIG. 1.

In FIG. 4, together with FIG. 1, the treatment chamber 30 is seen to further include an inhibitor inlet 60 which leads to a ring manifold 62. The ring manifold is located within the chamber 30 in underlying relationship respective to a plate member 44′. A plurality of circumferentially spaced apart nozzles 64 are communicated with the manifold and radially directed towards a sucker rod 21 which extends through the before mentioned resilient wiper member 54.

The nozzles 64 are oriented respective to the sucker rod so that a continuous film of inhibitor chemical is applied to the entire outer surface area of the sucker rod string as the string is withdrawn through the enclosure 10 by lifting means 21 (FIG. 1), which can be a workover rig, for example.

FIG. 2 illustrates the details of the resilient packer means of chambers 12 and 24. The resilient packer means contained within the chambers 12 and 24 are identical to one another, and accordingly, only the packer means associated with chamber 12 will be explained in detail. The packer means 68 is captured within a pair of opposed shoes, one of which is illustrated by the numeral 70. The packer means is bisected into two elements along the longitudinal axis thereof so that the semi-circular half 72 of one element is captured within shoe 70, while the shoe 74 captures the remaining segment 76 of the packer. The shoes, 70 and 74, are moved towards and away from one another by means of adjustment screws 66 and 66'. The elements or segments of the bisected packer means 68 are apertured along the longitudinal central axis 78 thereof. The shoes are slidably captured by the illustrated floor rails, one of which is indicated by the numeral 80. Numeral 82 indicates an apertured plate member which can be a continuation of flange 14, or flange 26; or, alternatively, as seen in FIG. 1 together with FIG. 2, flange 82, 82'.

FIG. 3 sets forth the details of the blasting chamber 18, which is the before mentioned second chamber. The blasting chamber 18 is provided with an inclined baffle plate 82 which is apertured along the axial passageway 86 by the provision of a nipple 84. The nipple therefore forms part of the before mentioned rod-receiving central axial passageway which extends through the entire enclosure. The baffle divides the blasting chamber 18 into a lower and an upper chamber 87 and 88'. Outlet 89 conducts accumulated fluid away from the chamber 88'.

Numeral 90 indicates one of three nipples through which a mixture of sand and air, sand and water, small shot and air, or small shot and water can flow at high velocity and impinge with great abrading force against a medial length of the traveling sucker rod string.

Looking again now to FIG. 1, it will be noted that the enclosure is divided into a first or stripping chamber 12, a second or blasting chamber 18, a third or stripping chamber 24, and a fourth or inhibitor treatment chamber 30. The first stripping chamber 12 is divided into upper and lower chambers 87' and 92. The blasting chamber 18 is divided into upper and lower chambers 88' and 87, with chambers 87, 87' being in direct communication with one another.

The stripping chamber 24 is therefore divided into upper and lower chambers, 94 and 88, with chambers 88, 88' communicating with one another. The treatment chamber 30 is divided into upper and lower chambers, 96 and 94.

Figure 6:
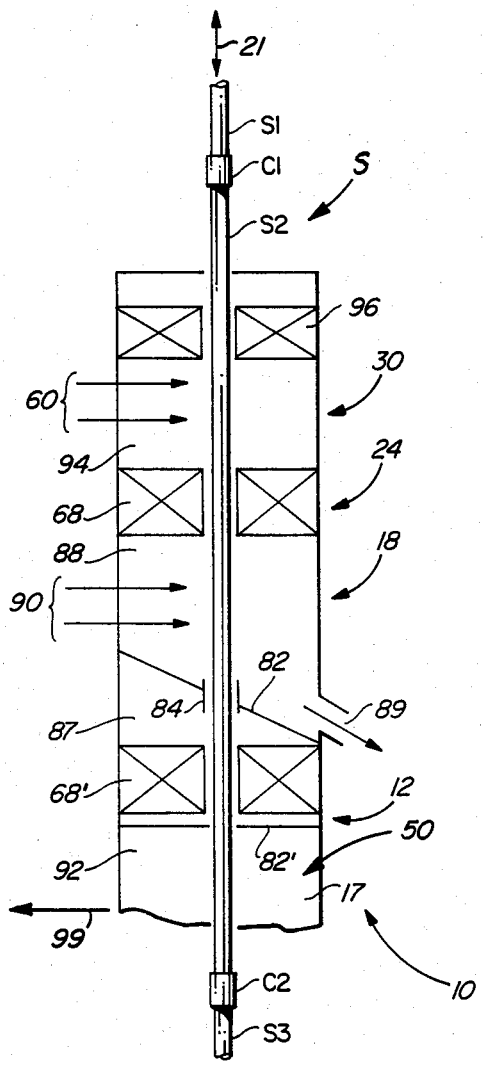

FIG. 6 is a flow sheet which sets forth the method of the present invention. As seen in FIG. 6, together with other figures of the drawings, a string of sucker rod S is made up of a plurality of joints S1, S2, S3 of sucker rods connected together by couplings C1, C2. The treatment chamber 10 is removably affixed to the top or upper terminal end portion of a wellhead 17, which can take on several different forms. The rod is lifted from the well and through the enclosure by lifting means 21.

As seen in FIG. 1, a source S'1 of water or air is pumped by pump means P through the illustrated venturi and into the blasting nozzle inlets 90. At the same time, abrasive material from source S'2 is sucked into the illustrated venturi device. The admixture of fluid and abrasive material flows through the supply piping 90, with there preferably being at least 3 circumferentially spaced apart blast nozzles 90' connected to the circumferentially spaced apart inlets 90.

Inhibitor from source I is pumped by pump means P into the inlet 60 wherein the inhibitor travels to the ring nozzle 62, flows through the circumferentially spaced apart nozzles 64, where the inhibitor impinges as a dense spray upon the outer surface of the rod string.

As seen in FIG. 6, together with other figures of the drawings, as the rod string is pulled uphole, and through the longitudinal passageway formed through the enclosure, a medial length of the rod is wipingly engaged by the packer means 68' of the first chamber. The segmented resilient packer elements are forced towards one another by means of opposed adjustment screws 66 and 66' in order to provide sufficient friction of the segmented packer element against the rod surface to cause well fluids and foreign matter to be stripped or wiped from the rod. Where deemed desirable, a second wiper device 50' can be positioned within chamber 92 in underlying relationship respective to packer means 68' so that the stripped material that falls down through plate member 82' cannot travel back into the wellbore. The cleaned rod extends through the aperture formed by nipple 84 and into the chamber 88, 88' where a blast of abrasive material impinges with great force against the outer peripheral surface of the rod. The arrangement of the nozzles, the velocity of the traveling rod, and the volumetric flow and pressure of the admixture of the abrasive material is of a value which cleans the outer surface of the rod down to the bright shiny metal.

As the rod is moved through the other stripping chamber 24, the packer element 68 thereof strips any residual material from the cleaned and abraded rod to assure that only the bright shiny metallic surface is exposed within chamber 94.

As the rod proceeds through the ring nozzle 62, a suitable corrosion inhibitor agent flows from the nozzles and impinges upon the exterior surface of the sucker rod. The corrosion inhibitor material adheres to the outer clean surface of the rod and is of a volumetric flow and pressure to cause the entire surface area of the rod to be thoroughly coated. The rod proceeds through the resilient wiper element 54 where surplus inhibitor agent is removed from the surface thereof and returned to the treating chamber located therebelow. After a joint of rod has been removed from or extended above the enclosure, the rod is unscrewed from the coupling and stored until needed.

The present invention provides both method and apparatus for cleaning and treating a sucker rod with an inhibiting agent at the wellhead, before the rod is brought into the atmosphere, and before the rod must be manually handled, so that the inhibiting agent is free to flow into the pores or surface imperfections of the rod which otherwise may be obscured with the foreign matter encountered by the rod downhole in the wellbore.

The present invention provides both method and apparatus by which a long string of sucker rod can be cleaned and inhibited so that while the rod is stored outside, corrosion thereof is negligible. More importantly, the inhibited rod has corrosion treatment chemical on the metallic outer surface thereof so that the inhibitor can migrate into the cracks and small fissures of the metallic rod. Furthermore, when the rod is again made up into a string of sucker rod and lowered downhole into a borehole, the outer surface of the rod will retain a significant amount of corrosion inhibitor thereon and thereby elongate the life of the string during its subsequent use in another wellbore.

The lowermost wiper at chamber 12 also prevents the abrasive material from the second chamber 18 from falling downhole. The packer device 68' and plate member 82' separate chamber 87' from the interior of the wellbore. Outlet 99 enables accumulated debris to be removed from space 87'.

The upper packer device 68 prevents the water and sand mixture from entering the inhibitor chamber 30, as well as removing all loose material from the surface of the string S.

The present invention is deemed to comprehend the cleaning and inhibiting of drill pipe, production pipe, sucker rod, and other tubular goods which are made into a string and run downhole into a borehole. The process can be carried out while running into or comming out of the borehole with a string of tubular goods.

EXAMPLE

A $\frac{5}{8}$ inch diameter string of sucker rod was removed from a borehole. Suitable blasting sand of #3 grit flowed at a rate of ten pounds per minute at S'2. Water flowed at 4000 psi at a rate of ten gallon per minute at S'1. Inhibitor flowed at 100 psi at a rate of 4 pounds per minute at 60. The inhibitor employed is commercially available Tretolite K.P.94 (TM). The rod was removed at a rate of about 600 feet per minute, not counting the lost motion while breaking out the joints.

The blasting nozzles at 90' are commercially available from Hydro-blast Mfg. Co. and are identified as model 0010. The treatment nozzles 64 are likewise commercially available from Hydro-blast Mfg. Co.

We claim:

1. Method of cleaning and inhibiting a sucker rod string as the string is being withdrawn from a borehole comprising the steps of:

(1) forming an enclosure which has an inlet end opposed to an outlet end; and, dividing the enclosure into a stripping chamber, a blasting chamber, ans an inhibitor chamber;

(2) attaching the inlet end of said enclosure to the upper end of the borehole; extending the upper marginal end of the string through the enclosure so that the entire string must move through the enclosure as the string is withdrawn from the borehole;

(3) engaging a medial length of the string and wiping the exterior of the string as the string travels through said stripping chamber to thereby remove a substantial amount of foreign matter from the surface thereof as the string is being withdrawn from the borehole and through the enclosure;

(4) further cleaning the string of step (3) as the string travels through said blasting chamber by directing a blast of abrasive material onto the exterior surface of the string at a location above the stripping chamber of step (3);

(5) cleaning a substantial amount of residual blasting material from the surface of the string at a location above the blasting location;

(6) coating the surface of the string with a corrosion inhibitor by applying the inhibitor to the outer surface of the string as the string passes through said inhibitor chamber which is located above the area where cleaning step (5) is carried out as the string is withdrawn from the borehole;

(7) breaking the string down into individual lengths of rods after carrying out step (6).

2. The method of claim 1 wherein step (3) is carried out by biasing a resilient packer member into engagement with a medial length of the string; and step (4) is carried out by flowing a mixture of sand and high pressure fluid into a plurality fo sand blasting nozzles and arranging the blasting nozzles circumferentially about the string and within said blasting chamber.

3. The method of claim 1 wherein step (5) is carried out by biasing a resilient packer means into engagement with a medial length of the string; and step (6) is carried out by spraying a corrosion resistant inhibitor towards the string to cause the inhibitor to coat the entire outer surface of the string.

4. The method of claim 1 wherein step (3) is carried out by biasing a resilient packer member into engagement with a medial length of the string; and step (4) is carried out by flowing a mixture of fluid and sand through a plurality of sand blasting nozzles and arranging the blasting nozzles circumferentially about the string;

step (5) is carried out by biasing a resilient packer means into engagement with a medial length of the string; and step (6) is carried out by spraying a corrosion resistant inhibitor towards the string to cause the inhibitor to coat the outer surface of the string as the string travels through the inhibitor treatment chamber; and, wherein the enclosure chambers are axially spaced chambers; and, step (3) is carried out in the lowermost chamber; step (4) is carried out in the adjacent chamber overlying the lowermost chamber; and step (5) is carried out in a chamber which overlies the step (3) chamber.

5. Apparatus for cleaning and inhibiting a string of sucker rod as the string is being removed respective to a borehole, comprising; in combination:

an enclosure and a wellhead, said enclosure having an axial passageway formed therethrough through which said string can pass, means at one end of said enclosure by which the enclosure is removably attached to the wellhead;

means dividing said enclosure into a stripper chamber, a blasting chamber, a cleaning chamber, and a coating chamber; each of the recited chambers include axially aligned passageways formed therethrough which coincide with said axial passageway formed through said enclosure;

said stripper chamber includes first packer means for resiliently engaging a circumferentially extending marginal length of the string to wipe a substantial quantity of foreign material therefrom and thereby clean the outer surface thereof of unwanted material;

said blasting chamber includes means for producing a blast of abrasive material arranged circumferentially about the surface of the string and directed radially inwards towards said surface to clean said surface of unwanted material;

said cleaning chamber includes second packer means for resiliently engaging a circumferentially extending marginal length of said surface to wipe a substantial quantity of foreign material therefrom and thereby clean said surface of unwanted material;

said coating chamber includes means for applying a corrosion inhibitor agent to the cleaned surface as the string is moved along the longitudinal axis thereof and through the chamber whereby;

said string is cleaned and inhibited as the string is brought out of the borehole.

6. The combination of claim 5 wherein said blasting chamber includes a plurality of circumferentially arranged blast nozzles aligned radially towards the longitudinal axis of the enclosure for impinging said abrasive material with great impact onto said outer surface and thereby remove foreign material therefrom.

7. The combination of claim 6 wherein said first packer means of said stripping chamber and said second packer means of said cleaning chamber each include a bisected resilient cylinder, a shoe for each cylinder, means moving each said shoe towards and away from one another, said cylinder has an axial passageway formed therethrough which is aligned along the longitudinal axis of said enclosure.

8. The combination of claim 5 wherein said means for applying is a plurality of nozzles arranged within said coating chamber, each said nozzle is directed towards the longitudinal axis and includes a source of corrosion inhibitor material, means forcing the corrosion inhibitor material through said nozzles and against said surface with sufficient flow rate to completely coat said surface with the inhibitor material.

9. The combination of claim 5 wherein said first and second packer means each include a bisected resilient cylinder, a shoe for each cylinder, means moving each said shoe towards and away from one another, said cylinder has an axial passageway formed therethrough which is aligned along the longitudinal axis of said enclosure;

said means for producing a blast is a plurality of nozzles arranged within said blasting chamber, each nozzle thereof is directed towards the longitudinal axis and includes a source of abrasive material admixed with a fluid, means forcing the abrasive mixture through said nozzle and against said surface with sufficient force to clean debris therefrom.

10. The combination of claim 5 wherein said blasting chamber includes a plurality of circumferentially arranged blast nozzles arranged radially towards the longitudinal axis for impinging said abrasive material with great impact onto said surface to thereby further remove foreign material from the string;

said means for applying is a plurality of spray nozzles arranged within said coating chamber, each said spray nozzle is directed towards the longitudinal axis and includes a source of corrosion inhibitor material, means forcing the inhibitor material through said spray nozzle and against the rod surface with sufficient force to coat the entire outer surface of the rod string.

11. Apparatus for treating a string of sucker rod which extend downhole into a borehole as the string is pulled from the borehole, comprising:

an enclosure adapted to be axially aligned with the borehole, means by which said enclosure is subdivided into adjacent chambers; means by which the lowermost chamber of said chambers can be removably affixed to the upper end of the borehole, an axial passageway formed through said enclosure in aligned relationship respective to a string of sucker rod which may extend downhole into the borehole, when the lowermost chamber is affixed to the upper end of the borehole;

packer means in said lowermost chamber; said packer means includes a resilient member which can be urged into sliding engagement respective to a marginal length of the rod string to thereby strip contaminants from the outer surface of the rod string as the rod string is withdrawn from the borehole;

one of said chambers being a blasting chamber, said blasting chamber is located adjacent to said lowermost chamber, blast nozzle means circumferentially arranged about the longitudinal axis of said blasting chamber for flowing a blast of abrasive material towards the longitudinal axis of the blast chamber so that a marginal length of a string of rod which may extend through said enclosure is cleaned by impact of the flowing abrasive material against the outer surface thereof; said blast nozzle means are arranged radially towards said longitudinal axis for impinging said abrasive material with great impact onto the surface of the rod string to thereby further remove foreign material from the outer surface thereof;

one of said chambers being a cleaning chamber formed above said blast chamber, said cleaning chamber has another packer means mounted therein which includes a resilient member which can be urged into sliding engagement respective to a marginal length of the elongated member to thereby strip contaminants from the outer surface of the rod string as said rod string is withdrawn from the borehole;

said packer means of said stripping chamber and said cleaning chamber each include a bisected resilient cylinder, a shoe for each cylinder, means moving each shoe towards and away from one another, said cylinder has an axial passageway formed therethrough which is aligned along said longitudinal axis of said enclosure;

one of said chambers being a coating chamber formed above said cleaning chamber, said coating chamber includes means for applying an inhibitor to the clean outer surface of a rod string which may be moved along the logitudinal axis thereof and through the coating chamber whereby;

the outer surface of the rod string is cleaned and coated with an inhibitor againt prior to being withdrawn from said enclosure.

* * * * *

UNITED STATES PATENT AND TRADEMARK OFFICE

CERTIFICATE OF CORRECTION

PATENT NO. : 4,494,607

DATED : JANUARY 22, 1985

INVENTOR(S) : MICHAEL B. FORD and JIM B. GRIFFIN

It is certified that error appears in the above—identified patent and that said Letters Patent is hereby corrected as shown below:

Column 1, line 43, delete "to" in front of forms;

Column 7, line 36, correct the spelling of "and";

Column 10, line 49, correct the spelling of "longitudinal";

Line 52, substitute --agent-- for "against".

Signed and Sealed this

*Twenty-fifth* Day of *June 1985*

[SEAL]

*Attest:*

DONALD J. QUIGG

*Attesting Officer* *Acting Commissioner of Patents and Trademarks*